US005552120A

United States Patent [19]

Sechrist et al.

[11] Patent Number: 5,552,120

[45] Date of Patent: Sep. 3, 1996

[54] FCC APPARATUS WITH ENCLOSED VENTED RISER

[75] Inventors: Paul A. Sechrist, Des Plaines; David A. Lomas, Barrington; Edward C. Haun, Glendale Heights, all of Ill.

[73] Assignee: UOP, Des Plaines, Ill.

[21] Appl. No.: 395,142

[22] Filed: Feb. 27, 1995

Related U.S. Application Data

[62] Division of Ser. No. 804,311, Dec. 6, 1991, Pat. No. 5,393, 415.

[51] Int. Cl.[6] ..... F27B 15/08

[52] U.S. Cl. ..... 422/144; 422/145; 422/147

[58] Field of Search ..... 422/144, 145, 422/147; 208/161, 163, 164, 113

[56] References Cited

U.S. PATENT DOCUMENTS

| | | | |
|---|---|---|---|
| 3,053,752 | 9/1962 | Swanson | 422/144 |
| 4,173,527 | 11/1979 | Heffley et al. | 208/153 |
| 4,295,961 | 10/1981 | Fahrig et al. | 208/161 |
| 4,364,905 | 12/1982 | Fahrig et al. | 422/144 |
| 4,390,503 | 6/1983 | Walters et al. | 422/147 |
| 4,624,772 | 11/1986 | Krambeck et al. | 208/95 |
| 4,664,888 | 5/1987 | Castagnos, Jr. | 422/147 |
| 4,721,603 | 1/1988 | Krug et al. | 422/147 |
| 4,737,346 | 4/1988 | Haddad et al. | 422/144 |
| 4,786,622 | 11/1988 | Walters et al. | 422/144 |
| 4,792,437 | 12/1988 | Hettinger, Jr. et al. | 422/147 |
| 4,793,915 | 12/1988 | Haddad et al. | 208/161 |
| 4,869,880 | 9/1989 | Hettinger, Jr. et al. | 422/144 |
| 4,963,328 | 10/1990 | Haddad et al. | 422/144 |

*Primary Examiner*—Robert Warden
*Assistant Examiner*—Robert Carpenter
*Attorney, Agent, or Firm*—Thomas K. McBride; John G. Tolomei

[57] ABSTRACT

An FCC apparatus uses a highly efficient separation device to remove product from the catalyst so that the reactor vessel receives a low volume of feed hydrocarbons and riser by-products. The separation device encloses an upwardly directed outlet end of a ballistic separation device in low volume disengaging vessel that collects disengaged catalyst from the riser in a dense bed. Immediate contact of the dense bed with a stripping fluid minimizes the amount of hydrocarbons that are carried out of the disengaging vessel into the open volume of the reactor vessel.

3 Claims, 7 Drawing Sheets

FCC APPARATUS WITH ENCLOSED VENTED RISER

CROSS REFERENCE TO RELATED APPLICATION

This application is a Divisional application of prior application Ser. No.07/804,311, filed Dec. 6, 1991, now issued as U.S. Pat. No. 5,393,415.

FIELD OF THE INVENTION

This invention relates generally to processes for the fluidized catalytic cracking (FCC) of heavy hydrocarbon streams such as vacuum gas oil and reduced crudes. This invention relates more: specifically to a method for separating reaction products from the catalyst used therein.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium.

The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

One improvement to FCC units, that has reduced the product loss by thermal cracking and undesirable secondary catalytic cracking, is the use of riser cracking. In riser cracking, regenerated catalyst and starting materials enter a pipe reactor and are transported upward by the expansion of the gases that result from the vaporization of the hydrocarbons, and other fluidizing mediums of present, upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser designs use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

The benefits of using lift gas to pre-accelerate and condition regenerated catalyst in a riser type conversion zone are well known. Lift gas typically has a low concentration of heavy hydrocarbons, i.e. hydrocarbons having a molecular weight of $C_3$ or greater are avoided. In particular, highly reactive type species such as $C_3$ plus olefins are unsuitable for lift gas. Thus, lift gas streams comprising steam and light hydrocarbons are generally used.

Riser cracking whether with or without the use of lift gas has provided substantial benefits to the operation of the FCC unit. These can be summarized as a short contact time in the reactor riser to control the degree of cracking that takes place in the riser and improved mixing to give a more homogeneous mixture of catalyst and feed. A more complete distribution prevents different times for the contact between the catalyst and feed over the cross-section of the riser such that some of the feed contacts the catalyst for a longer time than other portions of the feed. Both the short contact time and a more uniform average contact time for all of the feed with the catalyst has allowed overcracking to be controlled or eliminated in the reactor riser.

Unfortunately, much of what can be accomplished in the reactor riser in terms of uniformity of feed contact and controlled contact time can be lost when the catalyst is separated from the hydrocarbon vapors. As the catalyst and hydrocarbons are discharged from the riser, they must be separated. In early riser cracking operations, the output from the riser was discharged into a large vessel. This vessel serves as a disengaging chamber and is still referred to as a reactor vessel, although most of the reaction takes place in the reactor riser. The reactor vessel has a large volume. Vapors that enter the reactor vessel are well mixed in the large volume and therefore have a wide residence time distribution that results in relatively long residence times for a significant portion of the product fraction. Product fractions that encounter extended residence times can undergo additional catalytic and thermal cracking to less desirable lower molecular weight products.

In an effort to further control the contact time between catalyst and feed vapors, there has been continued investigation into the use of cyclones that are directly coupled to the end of the reactor riser. This direct coupling of cyclones to the riser provides a quick separation of a large portion of the product vapors from the catalyst. Therefore, contact time for a large portion of the feed vapors can be closely controlled. One problem with directly coupling cyclones to the outlet of the reactor riser is the need for a system that can handle pressure surges from the riser. These pressure surges and the resulting transient increase in catalyst loading inside the cyclones can overload the cyclones such that an unacceptable amount of fine catalyst particles are carried over with the reactor vapor into downstream separation facilities. Therefore, a number of apparatus arrangements have been proposed for direct coupled cyclones that significantly complicate the arrangement and apparatus for the direct coupled cyclones, and either provide an arrangement where a significant amount of reactor vapor can enter the open volume of the reactor/vessel or compromise the satisfactory operation of the cyclone system by subjecting it to the possibility of temporary catalyst overloads.

Aside from the operational problems of dose coupled cyclones, such cyclones have an upper limit on the amount of product gases that they will carry through with the separated catalyst into the reactor vessel. As the catalyst flows from location to location it always has a certain amount of void space. Two types of void space make-up the total catalyst voltage, interstitial voltage which comprises the space between catalyst particles and skeletal void spaces that comprise the internal pore volume of the catalyst. In the direct connected cyclone schemes all of the catalyst from the riser enters the cyclones and fails into the reactor vessel. Product vapors from the riser fill all the void spaces of the catalyst leaving the cyclones. For a relatively dense catalyst bed this total voltage will contain at least 7 wt. % of the riser product. Therefore, direct connected cyclones can still carry a relatively large percentage of riser products into the reactor vessel. Thus, although direct coupled cyclone systems can help to control contact time between catalyst and feed vapors, they will not completely eliminate the presence of hydrocarbon vapors in the open space of a reactor vessel.

A different apparatus that has been known to promote quick separation between the catalyst and the vapors in the reactor vessels is known as a ballistic separation device which is also referred to as a vented riser. The structure of the vented riser in its basic form consists of a straight portion of conduit at the end of the riser and an opening that is directed upwardly into the reactor vessel with a number of cyclone inlets surrounding the outer periphery of the riser near the open end. The apparatus functions by shooting the high momentum catalyst particles past the open end of the riser where the gas collection takes place. A quick separation between the gas and the vapors occurs due to the relatively low density of the gas which can quickly change directions and turn to enter the inlets near the periphery of the riser while the heavier catalyst particles continue along a straight trajectory that is imparted by the straight section of riser conduit. The vented riser has the advantage of eliminating any dead area in the reactor vessel where coke can form while providing a quick separation between the catalyst and the vapors. However, the vented riser still has the drawback of introducing a large amount of product vapors into the open volume of the reactor vessel.

Therefore, with either separation system, product vapors are still present in the open volume of the reactor vessel from the stripped hydrocarbon vapors that are removed from the catalyst and pass upwardly into the open space above the stripping zone. While direct connected cyclones decrease the amount of hydrocarbon vapors in the open space of the reactor vessel, the vapors that do enter have a longer residence time. Since the dilute phase volume of the reactor vessel remains unchanged when direct connected cyclones are used and less hydrocarbon vapors enter the dilute phase volume from the riser, the hydrocarbon vapors that do enter the dilute phase volume will be there for much longer periods of time. (The terms "dense phase" and "dilute phase" catalysts as used in this application are meant to refer to the density of the catalyst in a particular zone. The term "dilute phase" generally refers to a catalyst density of less than 20 lb/ft$^2$ and the term "dense phase" refers to catalyst densities above 20 lb/ft$^2$. Catalyst densities in the range of 20 to 30 lb/ft$^2$ can be considered either dense or dilute depending on the density of the catalyst in adjacent zones or regions but for the purposes of this description are generally considered to mean dense.) In other words, when a direct connected cyclone system is used, less product vapors may enter the open space of the reactor vessel, but these vapors will have a much longer residence time in the reactor vessel. As a result, any feed and intermediate product components left in the reactor vessel are substantially lost to overcracking. As a result a substantial product loss is associated with either direct connected cyclones or a ballistic separation device.

DISCLOSURE STATEMENT

U.S. Pat. No. 4,390,503 and 4,792,437 disclose ballistic separation devices.

U.S. Pat. No. 4,295,961 and 4,963,328 show the end of a reactor riser that discharges into a reactor vessel and an enclosure around the riser that is located within the reactor vessel.

U.S. Pat. No. 4,737,346 shows a closed cyclone system for collecting the catalyst and vapor discharge from the end of a riser.

U.S. Pat. No. 4,624,772 issued to Krambeck et at., discloses a closed coupled cyclone system that has vent openings, for relieving pressure surges, that are covered with weighted flapper doors so that the openings are substantially closed during normal operation.

U.S. Pat. No. 4,664,888 issued to Castagnos and U.S. Pat. No. 4,793,915 issued to Haddad et. al., show baffle arrangements at the end of an upwardly discharging riser. The 915' patent shows the introduction of steam into the baffle arrangement for stripping catalyst that flows downward from the riser.

U.S. Pat. No. 4,173,527, issued to Heffley et al. on Nov. 6, 1979, discloses a method of separating catalyst and gases that surround the outlet end of a reactor riser with a small volume vessel.

PROBLEMS PRESENTED BY PRIOR ART

One problem faced by the prior art is the need to obtain a quick separation between catalyst and product vapors leaving an FCC riser in a system that minimizes overcracking of product vapors and the carryover of fine catalyst particles with the product vapors. The vented riser or ballistic separation device can provide a quick separation between catalyst particles and reactor vapors. However, the use of this type of device or other separation means at the end of the riser reentrains potential product in the open volume of the reactor where overcracking occurs.

Another problem is the loss of a significant portion of the product that the separated catalyst carries into the reactor vessel and stripper. When using a cyclone arrangement for separating a majority of the catalyst product, vapors fill the void volume of the catalyst. As the cyclones recover catalyst they transfer the catalyst together with products contained in the void volume into the reactor vessel and stripper. Product vapors that the catalyst carries into the reactor vessel and stripper are essentially lost to overcracking due to the long contact time therein. Accordingly, the more catalyst that the cyclones recover the more product vapors that are carried into the reactor vessel. The use of direct connected cyclone systems exacerbate the problem since the cyclones recover essentially all of the catalyst from the riser and the entire void fraction associated with the large volume of recovered catalyst carries product into the reactor vessel. Thus, direct connected cyclones can increase this secondary loss of product to overcracking. Moreover the resulting gases are very light, have little product value and increase the gas traffic in FCC recovery facilities..

BRIEF DESCRIPTION OF THE INVENTION

It is an object of this invention to improve processes and apparatus for reducing the hydrocarbon residence time in a reactor vessel It is another object of this invention to improve vented riser and close coupled cyclone separation devices in an FCC reactor.

A further object of this invention is to decrease the amount of hydrocarbon vapors that enter the dilute phase of a reactor vessel.

This invention is an FCC process having a reactor/riser that discharges catalyst into a vapor separation device at the end of a riser which obtains a very high initial separation of catalyst from the gas that exits the riser and effects a very low transfer of riser vapors into the reactor vessel By obtaining a very high initial separation of catalyst and riser gaseous products, the overcracking and resultant loss of the product that does reach the reactor vessel is inconsequential.

This invention is an FCC process that is arranged so that the outlet end of a reactor riser discharges into a low volume disengaging zone or vessel contained within an upper portion of a reactor vessel. The discharge end of the reactor riser is located near the top of the disengaging zone. The disengaging zone maintains a dilute catalyst phase above the discharge end of the riser and a dense catalyst phase below the discharge end of the riser. Outlets for a closed separation system withdraw vapors directly from the dilute phase of the disengaging zone into a separation device. Stripping gas passed into a lower section of the disengaging zone maintains fluidization of the dense bed phase and removes hydrocarbon product from the void spaces of the catalyst before it leaves the disengaging zone. It has been discovered that ballistically discharging the catalyst into a low volume disengaging zone will effect a highly efficient catalyst separation that is immediately combined with a high efficiency hydrocarbon separation in a low volume stripping zone. An important aspect of this invention is the discovery that a traditional ballistic separation device operates with a high separation efficiency in a very restrictive volume.

Accordingly in one embodiment this invention is a process for the fluidized catalytic cracking of an FCC feedstock. The process includes the steps of passing the FCC feedstock and the regenerated catalyst particles to a reactor riser and transporting the catalyst and feedstock upwardly through the riser to convert the feedstock to a gaseous product stream and produce spent catalyst particles by the deposition of coke on the regenerated catalyst particles. A first mixture of spent catalyst particles and product vapors are discharged from the end of the riser upwardly into a dilute phase of a substantially closed disengaging zone which is at least partially contained within the reactor vessel. Catalyst collects in the disengaging zone and forms a dense bed of catalyst having a top surface below the discharge end of the riser. A first stripping fluid stream passes into the disengaging zone upwardly through the dense bed to strip hydrocarbons from the catalyst in the dense bed. A first stripping effluent fluid flows upwardly from the dense bed into the dilute phase. A vapor seal maintained between the disengaging zone and the reactor vessel restricts the flow of product vapors out of the disengaging zone. Catalyst passes out of the disengaging zone from the dense bed to a stripping zone. A second stripping fluid stream contacts catalyst in the stripping zone. A second stripping effluent passes out of the stripping zone and is withdrawn from the process. A product stream comprising the product vapors and first stripping effluent are collected from the dilute phase of the disengaging zone and recovered from the process.

In another embodiment, this invention is a process for the fluidized catalytic cracking of an FCC feedstock. The process includes the steps of passing the FCC feedstock and regenerated catalyst particles to a reactor riser and transporting the catalyst and feedstock upwardly through the riser to convert the feedstock to product vapors and produce spent catalyst particles by the deposition of coke on the regenerated catalyst particles. A first mixture of spent catalyst particles and product vapors are discharged from a discharge end of the riser upwardly into a dilute phase of a low volume disengaging zone contained within the reactor vessel. The disengaging zone has a substantially closed bottom and a transverse cross-sectional area of between 4 to 5 times the cross-sectional area of the riser discharge end. Catalyst collects in a first annular section of the disengaging zone to form a dense bed of catalyst in the annular section below the discharge end of the riser. A first stripping fluid stream passes upwardly through the dense bed in the first annular section and strips hydrocarbons from the catalyst in the dense bed. A first stripping effluent fluid passes upwardly from the dense bed into the dilute phase. Catalyst passes downwardly out of the first annular bed, upwardly through a second annular section and is discharged from the top of the second annular section into the reactor vessel. The second annular section has a coextensive vertical length with the first annular bed to provide a gas seal between the reactor vessel and the disengagement zone. Catalyst passes from the reactor vessel to a stripping zone where a second stripping fluid stream contacts the catalyst and produces a second stripping effluent that passes upwardly from the stripping zone. The second stripping effluent flows into the disengaging zone under restrictive flow conditions that create a positive gas flow from the interior of the reactor vessel to the dilute phase of the disengaging zone. A product stream comprising the product vapors and the first and second stripping effluents from the dilute phase of the disengaging zone are collected by an annular collector that surrounds the discharge end of the riser. The product stream passes in closed communication from the collector to a cyclone separator and a product stream is recovered from the cyclone separator.

In another embodiment this invention is an apparatus for the fluidized catalytic cracking of an FCC feedstock by contact with an FCC catalyst. The apparatus includes an upwardly directed riser conduit that has an upwardly directed outlet end. A reactor vessel surrounds the outlet end of the riser and at least partially contains a disengaging vessel that also surrounds the outlet end of the riser. The disengaging vessel has a bottom substantially closed to direct catalyst flow and a catalyst outlet located below the outlet end of the riser. A distributor located below the catalyst outlet in the disengaging zone introduces a gaseous medium into the disengaging vessel. A stripping vessel communicates with the reactor vessel and is located subadjacent thereto. The disengaging vessel has a product outlet for withdrawing a product stream from an upper portion of the disengaging vessel.

The arrangement of the disengaging zone and its location within the reactor vessel offers a number of advantages. By the use of the ballistic discharge the amount of catalyst withdrawn from the disengaging vessel into the cyclones is greatly reduced such that typically less than 20 wt. % of catalyst entering the disengaging vessel will be withdrawn with the product stream entering the cyclones. In addition, the dense bed occupies a substantial portion of the disengaging zone and thereby minimizes the dilute phase volume in which overcracking can occur. Further reductions in overcracking result from the immediate stripping of catalyst in the dense phase bed of the disengaging vessel.

The fact that this invention also reduces the amount of catalyst recovered by the cyclones over closed cyclone systems is important. As catalyst exits the riser, the disengaging vessel of this invention recovers at least 80 and in most cases over 90% of the catalyst without passing the catalyst through the cyclones. Again, stripping fluid contacts the catalyst as it passes through the disengaging vessel and removes the product vapors from the void volume of the catalyst in the dense bed of the disengaging vessel. Since up to 7 vol % of the hydrocarbon vapors leaving the riser can be carried out with the catalyst, this stripping of a majority of the catalyst in the restricted volume of the disengaging vessel allow an additional 2 to 4% of the product vapors from the riser to be collected from the disengaging vessel.

Other advantages, aspects, embodiments and details of this invention are set forth in the following detailed description of the invention.

DETAILED DESCRIPTION OF THE INVENTION

This invention relates generally to the reactor side of the FCC process. This invention will be useful for most FCC processes that are used to crack light or heavy FCC feedstocks. The process and apparatus aspects of this invention can be used to modify the operation and arrangement of existing FCC units or in the design of newly constructed FCC units.

This invention uses the same general elements of many FCC units. A reactor riser provides the primary reaction zone. A reactor vessel with a separation device removes catalyst particles from the gaseous product vapors. A stripping zone removes residual sorbed catalyst particles from the surface of the catalyst. Spent catalyst from the stripping zone is regenerated in a regeneration zone having one or more stages of regeneration. Regenerated catalyst from the regeneration zone re-enters the reactor riser to continue the process. A number of different arrangements can be used for the elements of the reactor and regenerator sections. The description herein of specific reactor and regenerator components is not meant to limit this invention to those details except as specifically set forth in the claims.

Figure 1:
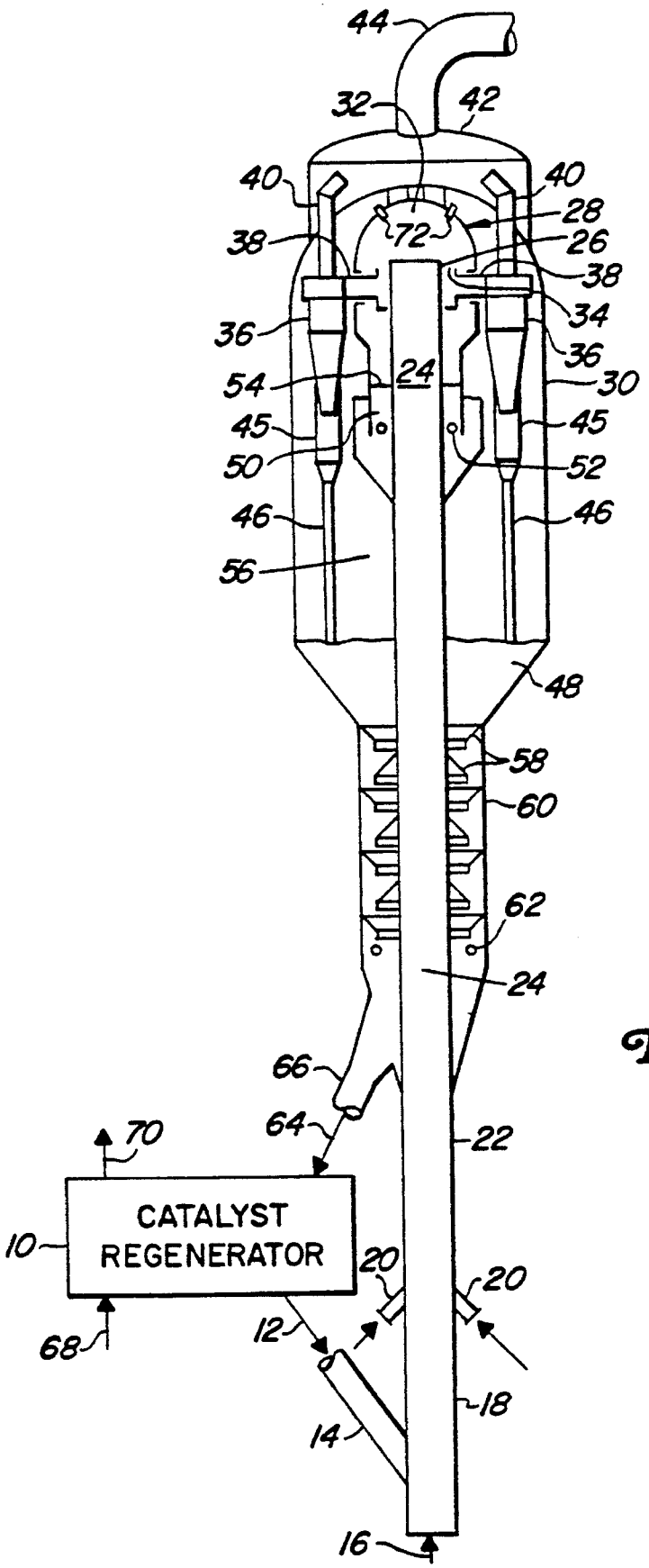
FIG. 1 is a sectional elevation of a reactor having a riser separation device of this invention.

An overview of the basic process operation can be best understood with reference to FIG. 1. Regenerated catalyst from a catalyst regenerator 10 (shown schematically) is transferred by a conduit 12, to a Y-section 14. Lift gas injected into the bottom of Y-section 14, by a conduit 16, carries the catalyst upward through a lower riser section 18. Feed is injected into the riser above lower riser section 18 by feed injection nozzles 20.

The mixture of feed, catalyst and lift gas travels up an intermediate section 22 of the riser and into an upper internal riser section 24 that terminates in an upwardly directed outlet end 26. Riser outlet end 26 is located in a disengaging zone in the form of a disengaging vessel 28 which in turn is located in a reactor vessel 30. The gas and catalyst are separated in dilute phase section 32 of the disengaging vessel. The disengaging vessel has substantially dosed sidewalls and a substantially closed top and bottom. Substantially closed is defined to mean that the disengaging vessel has only small nozzles or restricted openings for communicating fluids or catalyst into or out of the disengaging vessel.

An outlet 34 collects the separated gases and small amounts of catalyst from dilute phase 32 and transfers this material to one or more cyclones 36 via conduits 38 Cyclones 36 swirl the gas and catalyst mixture to separate the heavier catalyst particles from the gas. Conduits 40 withdraw the separated gases from the top of the cyclones 36 and a plenum chamber 42 collects the gases for transfer out of the reactor by overhead conduit 44. Separated catalyst from cyclones 36 drops downward from the dust hoppers 45 of the cyclones into the reactor through dip legs 46 into a catalyst bed 48.

Catalyst separated in disengaging chamber 28 drops from dilute phase section 32 into a catalyst bed 50. Catalyst bed 50 is maintained as a dense bed which is defined to mean a catalyst bed with a density of at least 20 lb/ft$^3$. Steam from a distributor 52 contacts catalyst in the bed 50. Catalyst drains from disengaging vessel 28 at a rate that maintains a catalyst bed level 54. Catalyst is discharged from disengaging vessel 28 also collects in the bed 48.

Reactor vessel 30 has an open volume above catalyst bed 48 that provides a dilute phase section 56. Catalyst cascades downward from bed 48 through a series of frusto-conical baffles 58 that project transversely across the cross-section of a stripping zone in stripper vessel 60. Preferably, the stripping zone communicates directly with the bottom of reactor vessel 30 and more preferably at a sub-adjacent location relative thereto. As the catalyst falls, steam or another stripping medium from a distributor 62 rises countercurrently and contacts the catalyst to increase the stripping of adsorbed components from the surface of the catalyst. A conduit 64 conducts stripped catalyst via a nozzle 66 into catalyst regenerator 10. An oxygen-containing gas 68 that enters a catalyst regenerator reacts with coke on the surface of the catalyst to combustively remove coke that is withdrawn from the regenerator as previously described through conduit 12 and produce a flue gas stream comprising the products of coke combustion that exits the regeneration through a line 70.

The countercurrently rising stripping medium desorbs hydrocarbons and other sorbed components from the catalyst surface and pore volume. Stripped hydrocarbons and stripping medium rise through bed 48 and into the dilute phase 56 of reactor vessel 30. At the top of dilute phase 56 an outlet withdraws the stripping medium and stripped hydrocarbons from the reactor vessel. One method of withdrawing the stripping medium and hydrocarbons is shown in FIG. 1 as nozzle 72 which evacuates the reactor vessel product stream from the upper section of dilute phase 56 through the top of disengaging vessel 28. Other nozzles can be used to recover the reactor product stream independently from the riser gaseous products.

The conduit 44, referred to as the reactor vapor line recovers the reactor effluent and transfers the hydrocarbon product vapor of the FCC reaction to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

The reactor riser used in this invention discharges into a device that performs an initial separation between the catalyst and gaseous components in the riser. The term "gaseous components" includes lift gas, product gases and vapors, and unconverted feed components. The drawing shows this invention being used with a riser arrangement having a lift gas zone 18. A lift gas zone is not a necessity to enjoy the benefits of this invention.

The end of the riser will terminate with one or more upwardly directed openings that discharge the catalyst and gaseous mixture in an upward direction into a dilute phase section of the disengaging vessel. The open end of the riser is of an ordinary vented riser design as described in the prior art patents of this application or of any other configuration that provides a substantial separation of catalyst from gaseous material in the dilute phase section of the reactor vessel. It is believed to be important that the catalyst is discharged in an upward direction in the disengaging vessel to minimize the necessary distance for catalyst disengagement between the outlet end of the riser and the top of the catalyst bed 54 in the disengaging vessel. The flow regime within the riser will influence the separation at the end of the riser. Typically, the catalyst circulation rate through the riser and the input of feed and any lift gas that enters the riser will produce a flowing density of between 0.1 $lb/ft^3$ to 20 $lb/ft^3$, with typical catalyst densities below 5 $lb/ft^3$ and an average velocity of about 10 ft/sec to 100 ft/sec for the catalyst and gaseous mixture. The length of the riser will usually be set to provide a residence time of between 0.5 to 10 seconds at these average flow velocity conditions. Other reaction conditions in the riser usually include a temperature of from 920°–1050° F.

The separation device of this invention will achieve 95 wt. % recovery or more of the riser gaseous components from the catalyst that returns to the reactor vessel. Since the catalyst that returns to the reactor usually has a void volume which will retain at least 7 wt. % of the riser gaseous components, some of the riser gaseous components must be displaced from the catalyst void volume to achieve the over 95 wt. % recovery of product components. Maintaining the dense catalyst bed below to the riser outlet minimizes the dilute phase volume of the catalyst and riser products, thereby avoiding the aforementioned problems of prolonged catalyst contact time and overcracking. A low volume dense bed arrangement reduces the concentration of riser products in the interstitial void volume of the catalyst to equilibrium levels by passing a displacement fluid therethrough. Maintaining a dense bed and passing a displacement fluid through the bed allows a near complete displacement of the riser gaseous products from catalyst leaving the disengaging zone. Restricting the catalyst velocity through the dense bed also facilitates the displacement of riser gaseous components. The catalyst flux or catalyst velocity through the dense bed should be less than the bubble velocity though the bed. Accordingly the catalyst velocity through the bed should not exceed 1 ft/sec. Protracted contact of the catalyst with the displacement fluid in the dense bed can also desorb additional gaseous riser products from the skeletal pore volume of the catalyst. The disengaging vessel can also include a series of baffles to improve the contact of the catalyst with any stripping gas that passes upwardly through the vessel. However in order to obtain the prestripping advantage as previously described it is essential that a dense bed section is maintained at the top of the disengaging vessel. Such stripping baffles, when provided, can function in the usual manner to cascade catalyst from side to side as it passes through the lower section of the disengager vessel and will be located below a dense bed section in the disengaging vessel. However, the benefits of increased product recovery must be balanced against the disadvantage of additional residence time for the reactor products in the separation device.

Figure 2:
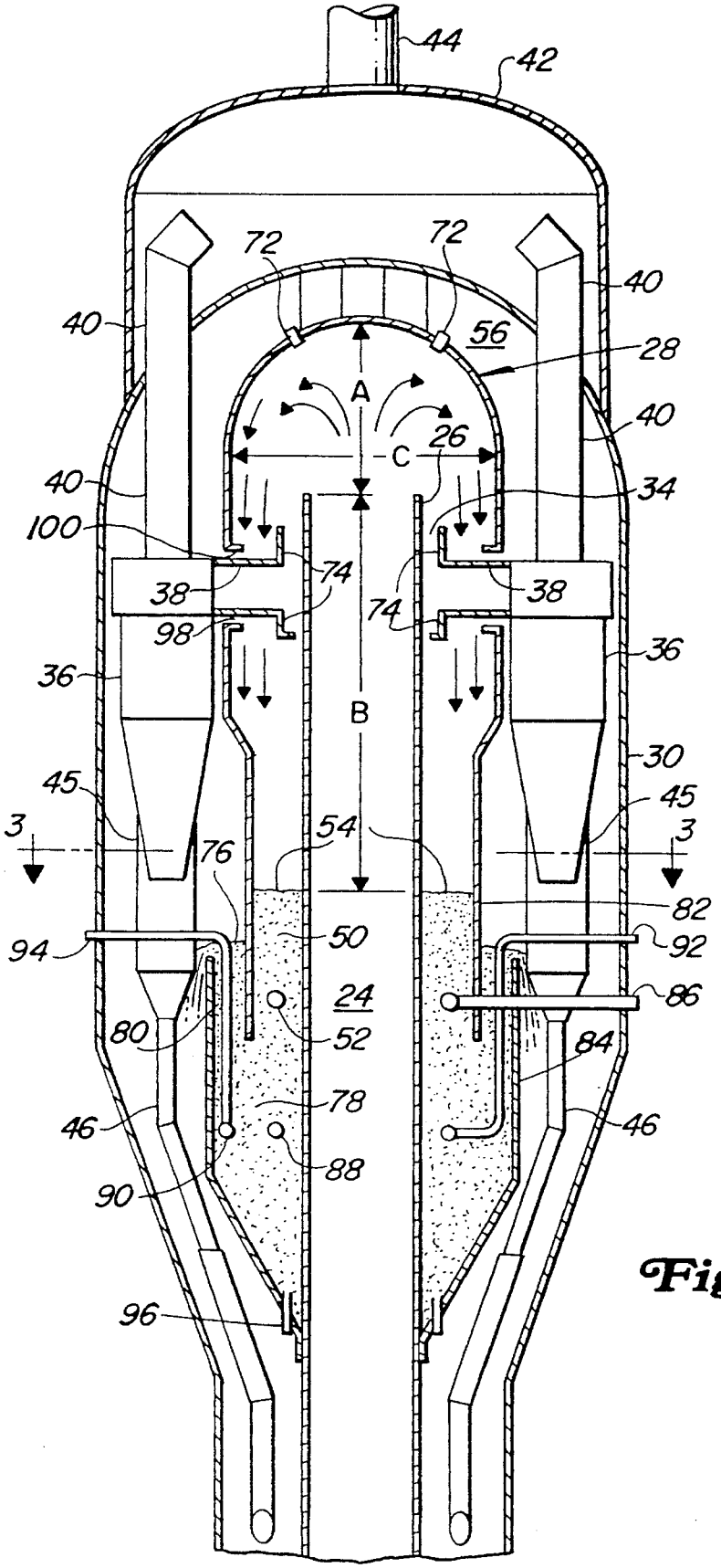
FIG. 2 is an enlarged sectional elevation of a riser separation device of this invention.

An enlarged view of the disengaging vessel of FIG. 1 is shown in FIG. 2. The same reference numerals are used to denote similar equipment in FIGS. 1 and 2. As FIG. 2 shows in more detail, the exact layout and nature of the disengaging zone can be more fully understood by reference to FIG. 2.

Referring then to FIG. 2, the velocity at which the catalyst and gaseous mixtures discharge from end 26 of the riser also influences the placement of the end of the riser relative to the top of the disengaging vessel. This distance, indicated by the letter "A" in FIG. 2, is set on the basis of the flow rate to riser. In the interest of minimizing the dilute volume of catalyst in the disengaging vessel, distance "A" should be kept as short as possible. Nevertheless, there is need for some space between the end of the riser and the top of the disengagement vessel. Providing a distance as defined by dimension A avoids direct impingement and the resulting erosion of the top of the reactor vessel. Moreover, the discharge of catalyst from the end of the riser requires a space to provide a separation while preventing the re-entrainment of catalyst particles with the gas stream collected by outlet 34. Since the reactor riser is usually designed for a narrow range of exit velocities between 20 to 100 ft/sec, distance "A" can be set on the basis of riser diameter. In order to avoid erosion of the upper surface of the reactor vessel, the distance A should be at least 1 riser diameter or more. The avoidance of catalyst re-entrainment after discharge of the riser is influenced by both the riser velocity and the flowing density of the catalyst as it passes downward through the disengaging vessel. For most practical ranges of catalyst density in the riser, the distance of 1.5 to 6 riser diameters for dimension "A" is adequate for a flowing catalyst density, often referred to as "catalyst flux", of about 50–200 lb/ft$^2$/sec. This dimension A will usually be in a range of from 1.5 to 5 riser diameters and more preferably in a range of from 1.5 to 3 riser diameters.

In the disengager vessel the total dilute phase volume of the vessel is determined by the diameter of the disengager vessel, dimension C, the distance from the end of the riser to the top of the disengager vessel, dimension "A", and the distance from the discharge end of the riser to the top of the dense bed level in the reactor vessel which is shown as dimension "B" in FIG. 2. Preferably, all of these dimensions are minimized to produce a low volume disengaging vessel. In order to minimize re-entrainment of catalyst particles into the any gases that rise from catalyst bed 50, a vertical space must separate riser outlet end 26 and the upper bed level 50. The desired length of this space, represented by dimension B, is primarily influenced by the superficial velocity of the gases that flow upwardly through dense bed 50. A superficial velocity typically preferably below 0.5 ft/sec will minimize the potential for re-entrainment of the gaseous compounds passing through bed 50. The gaseous components passing upward through bed 50 include hydrocarbons that are desorbed from the surface of the catalyst and a stripping fluid stream.

The amount of stripping gas entering the disengaging zone from distributor 52 is usually proportional to the volume of voids in the catalyst passing therethrough. In this invention it is preferred that the amount of stripping gas entering the disengaging vessel be adequate to displace hydrocarbons from the interstitial void area of the catalyst. For most reasonable catalyst to oil ratios in the riser, the amount of stripping gas that must be added to displace the interstitial void volume of the catalyst will be about 1 wt % of the feed. It is essential to the disengager stripper function, also called pre-stripping, that the catalyst in the bottom of the disengager vessel be maintained as a dense bed. The dense bed minimizes the interstitial voltage of the catalyst. As previously mentioned the catalyst bed at dense conditions operates in a bubble phase where gas moves upwardly relative to the catalyst bed. In order to keep gas passing upwardly and out of the bed the downward catalyst in the bed must not exceed the approximately 1 foot per second relative upward velocity of the gas bubbles. Since the removal of the product vapors from the interstitial voids of the catalyst is dependant on equilibrium, a higher steam rate through the dense bed can recover additional amounts of product hydrocarbons from the interstitial as well as the skeletal voids of the catalyst. As more stripping medium enters the disengaging vessel it will provide a more complete stripping function. However, as the addition of stripping medium to the dense bed increase so does the entrainment of catalyst out of the bed and the carry-over of catalyst into the cyclone system shown in FIG. 1. Thus, thorough stripping in the disengager vessel increases the gas flow rate through the disengaging vessel and usually the length of dimension B. Consequently, the benefits of more complete stripping come at the expense of additional dilute phase volume in the disengaging vessel. As long as the superficial velocity of the gases rising through bed 50 stays below about 1.0 ft/sec and preferably below about 0.5 ft/sec, a dimension B of 2 feet or one riser diameter will prevent substantial re-entrainment of the catalyst and the gases exiting the reactor vessel. More typically the dimension B will equal 4 feet, which roughly equates to 2 to 3 riser diameters. Of course the superficial velocity through the dense bed is a primary function of the cross section of the dense bed or lower disengager diameter. The diameter of the disengager vessel can be adjusted to achieve the desired superficial velocity but should be minimized to limit the total disengager volume.

The manner in which the gaseous vapors are withdrawn from the dilute phase volume of the disengager vessel will also influence the initial separation and the degree of re-entrainment that is obtained in the disengager vessel. In order to improve this disengagement and avoid re-entrainment, FIG. 2 shows the use of an annular collector or cup 74 that surrounds the end 26 of the riser. Typically, conduit 38 supports cup 74 from the top of the reactor vessel 30 through cyclones 36 and withdrawal conduits 40. With support from the conduits 40, cup 74 does not contact riser 24. A small annular space between cup 74 and riser 24 allows relative movement between the riser and the cup to accommodate thermal expansion. Conduits 38 are symmetrically spaced around the annular collector 74 and communicate with the annular collector through a number of symmetrically spaced openings to obtain a balanced withdrawal of gaseous components around the entire circumference of the reactor riser. In FIG. 2, cup 74 withdraws all of the gaseous components and product vapors from the disengaging zone. Cyclones 36 receive all of the withdrawn gases and catalyst from cup 74.

The upper diameter of disengaging vessel 28 is typically sized on the basis of the riser diameter or flowing cross-sectional area of the riser. The transverse cross-section of the disengaging vessel as denoted by letter C in FIG. 2 will be broadly within a range of from 1½ to 5 riser diameters with a range of from 2 to 2½ riser diameters being particularly preferred. This range of riser diameters is selected so that catalyst discharged from the riser will be deflected along the wall of the disengaging vessel and will preferentially travel along the outer area of the disengaging vessel. By streaming catalyst along the outer portions of the disengaging vessel, catalyst is kept out of opening 34 of cup 74. In arrangements where gases are withdrawn from the dilute phase directly from the sidewall of the disengaging vessel, it may be beneficial to further decrease the diameter of the disengaging vessel to avoid a concentrated flow of catalyst along the outer wall of the disengaging vessel. In most cases, the minimum cross-section available for the downward flow of the catalyst from the riser will be equal to the cross-sectional area of the riser. Thus, in terms of cross-sectional area, the minimum transverse cross-section of the disengaging vessel is twice the cross-sectional area of the riser. Where a collector cup 74 is present, the inlet opening will typically have an annular cross-sectional area that again equals the diameter of the riser. Thus, where an annular collector is used, the cross-sectional area of the disengaging vessel may equal 4 to 6 times the cross-sectional area of the riser. It is possible to have more than 1 riser outlet end discharged into the disengaging vessel. In such cases, the sizing of the disengaging vessel would be based upon an effective diameter of the riser based on the total flowing cross-sectional area of the riser discharge ends.

With the apparatus of this invention only a small amount of the catalyst that enters the process through the riser passes to cyclone separators. Since the amount of gases that are carried out of the cyclones with the separated catalyst is relatively high, minimizing cyclonic separation of the catalyst and riser gaseous products by the method of the invention reduces the amount of riser gaseous products that are carried into the reactor vessel. The catalyst that is recovered by the cyclones may be returned to any point of the process that puts it back into the circulating inventory of catalyst.

Preferably, the catalyst will be returned to the dense bed in the reactor vessel or stripping zone.

Most of the catalyst that enters the reactor vessel or the stripping zone is discharged from the dense bed of the disengaging vessel. Catalyst may be discharged from the dense bed of the disengaging zone in any manner that will maintain a dense bed that can be stripped in the manner previously described. In addition, a catalyst seal between the dilute phase of the disengaging vessel and the dilute phase of the reactor vessel must be maintained while discharging catalyst from the disengaging vessel.

The lower section of the disengaging vessel in FIG. 2 illustrates one method for discharging catalyst and maintaining a gas seal. In this arrangement, dense bed 50 flows downwardly as catalyst is discharged from an outlet 76. Bed 50 acts as a downcomer for catalyst flow which then changes direction in a lower section 78 and begins to flow upwardly in an upcomer section 80 out of which the catalyst spills from opening 76. As gas disengages in the downcomer section 50, an effective gas seal is formed to inhibit the flow of gas out of the disengaging vessel. The upcomer and downcomer sections are preferably formed by a downwardly projecting extension 82 of the disengaging vessel sidewall that is overlapped by a sidewall 84. Sidewall 84 extends upwardly from the bottom of the disengaging vessel and overlaps the lower section of sidewall 82. In this manner, the upper end of sidewall 84 forms an overflow weir that maintains catalyst in bed 50 at the top bed level 54.

Figure 3:
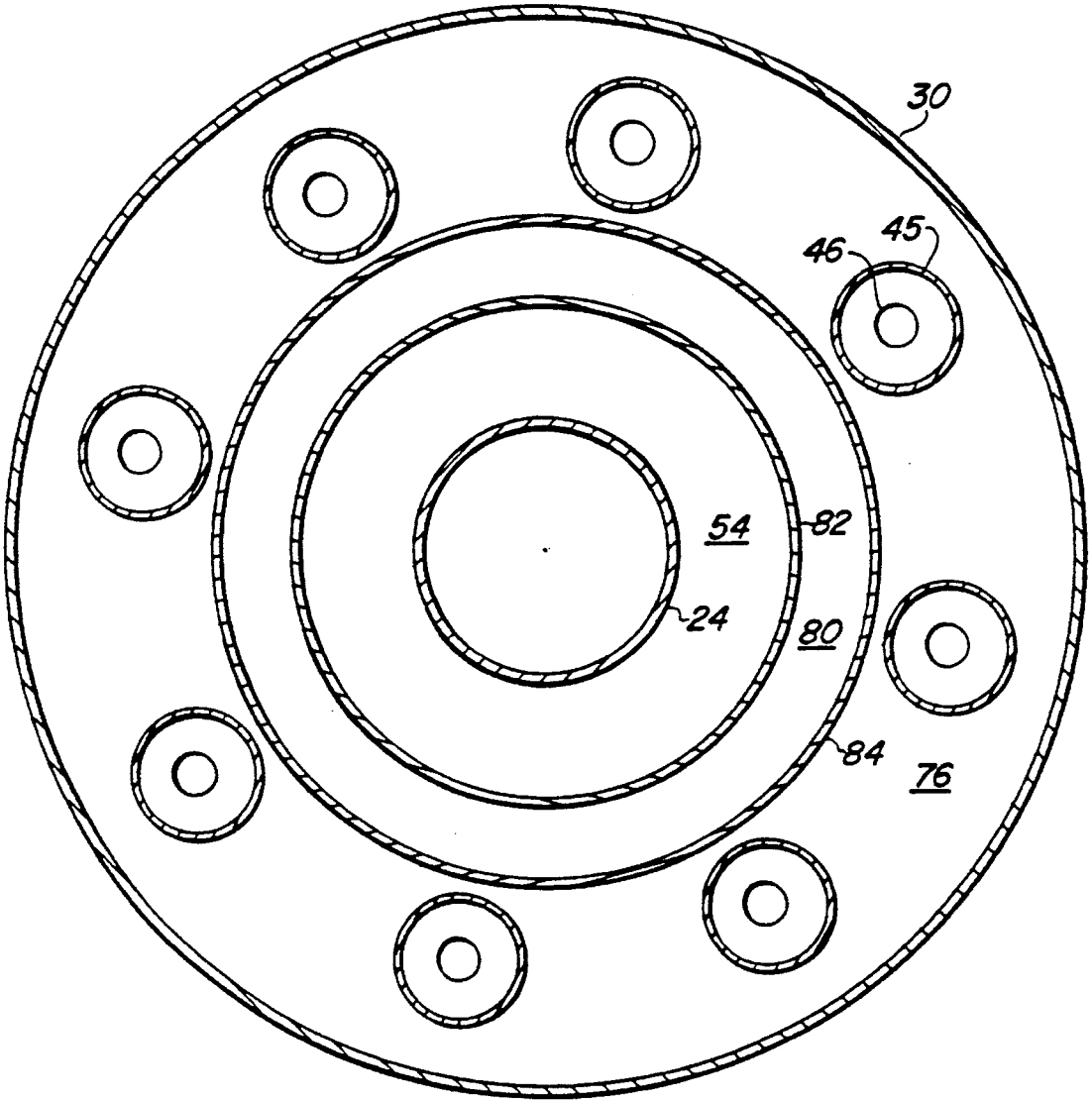
FIG. 3 is a cross-section of FIG. 2 taken across line 3—3.

The flow of catalyst through the disengager arrangement of FIG. 2 may be more fully understood by reference to FIG. 3, which is a cross-section of FIG. 2 taken at lines 3—3. Catalyst first flows upwardly in a fast dilute phase flow through the interior of riser 24. After disengagement of the gases from the catalyst, the catalyst collects in dense bed 54 and flows downwardly around sidewall 82 and upwardly into upcomer 80 before cascading over the top of sidewall 84 and flowing downwardly through dilute phase 76 of reactor vessel 30. Catalyst in dilute phase 76 flows around dust hoppers 45 and dip legs 46 of the cyclones.

The height of bed level 54 with respect to outlet 76 will vary with the pressure differential between the inside of the disengaging vessel and the inside of the reactor vessel. Typically, the reactor vessel will operate at a pressure of at least 0.2 psi higher than the interior of the disengaging vessel. This positive pressure differential creates a head of catalyst in the upcomer and maintains the top of the bed level 54 above top of sidewall 84. The difference in height between the top 54 of the catalyst bed and the overflow level of catalyst from upcomer 80 varies with the catalyst density in the upcomer and domcomer as well as the differential pressure between the reactor and disengaging vessels. Since the stripping operation usually lowers the catalyst density in the domcomer relative to the upcomer, a ¼ lb pressure differential usually produces 1 to 2 feet difference in the height between top of bed 54 and the top of the catalyst crest as it overflows out of outlet 76.

The lowermost portion of the disengaging zone is designed to maintain catalyst flow and to make the disengaging zone serf emptying during shutdown. In addition to the stripping fluid that enters distributor 52 via conduit 86, aeration gas is also added to the bottom of the bed via an inner distributor 88 and an outer distributor 90 which receive an aeration fluid, preferably steam, through conduits 92 and 94, respectively. This additional aeration maintains fluid flow in the bottom of the disengaging vessel. The bottom of the disengaging vessel also includes one or more small drain ports 96 which serve to empty the bottom of the disengaging vessel when the FCC unit ceases operation, but do not otherwise substantially affect the flow of catalyst through the dense bed of the disengaging vessel.

All of the catalyst that drains from the disengaging vessel and the cyclones passes through an additional stripping zone is previously described. The composition of the stripping fluid is typically steam, the usual stripping medium for FCC units. Once the stripping fluid has contacted the catalyst in the additional stripping zone, it is withdrawn from the reactor vessel. The stripping effluent from outside the disengaging vessel may be withdrawn directly from the stripping zone or reactor vessel, or passed back into the disengaging vessel and withdrawn with the gaseous components from the disengaging vessel. It is preferred that no stripping effluent that enters the disengaging zone pass through the dense catalyst bed.

When stripping effluent is vented back into the disengaging vessel, the openings through which the stripping effluent passes are sized to maintain a positive flow of the stripping effluent into the dilute phase of the stripping vessel. Nozzles 72 shown in the top of disengaging vessel 28 are thus sized to provide a positive gas flow. Nozzles 72 are located in the top section of the reactor vessel to maintain a flow of fluid in that region and prevent the condensation of coke from stagnant hydrocarbon vapors. As previously mentioned, the disengaging vessel is typically supported from the top head of the reactor vessel as are conduits 38 that pass through the sidewalls of disengaging vessel 28 and support cup 74. However the disengaging vessel 28 and the conduit 38 are supported from different points on the top head of reactor 30. Since the internals in the reactor vessel will tend to heat at different rates during start-up or shut-down of the FCC unit, a gap 98 is provided between the conduits and an opening 100 in the disengaging vessel to accommodate small mounts of differential thermal expansion. The additional flow area provided by gap 98 can affect the pressure drop of any stripper effluent flowing from the reactor vessel into the disengaging vessel and should be accounted for when sizing the flow area for any stripping gas vented into the disengaging vessel.

Figure 4:
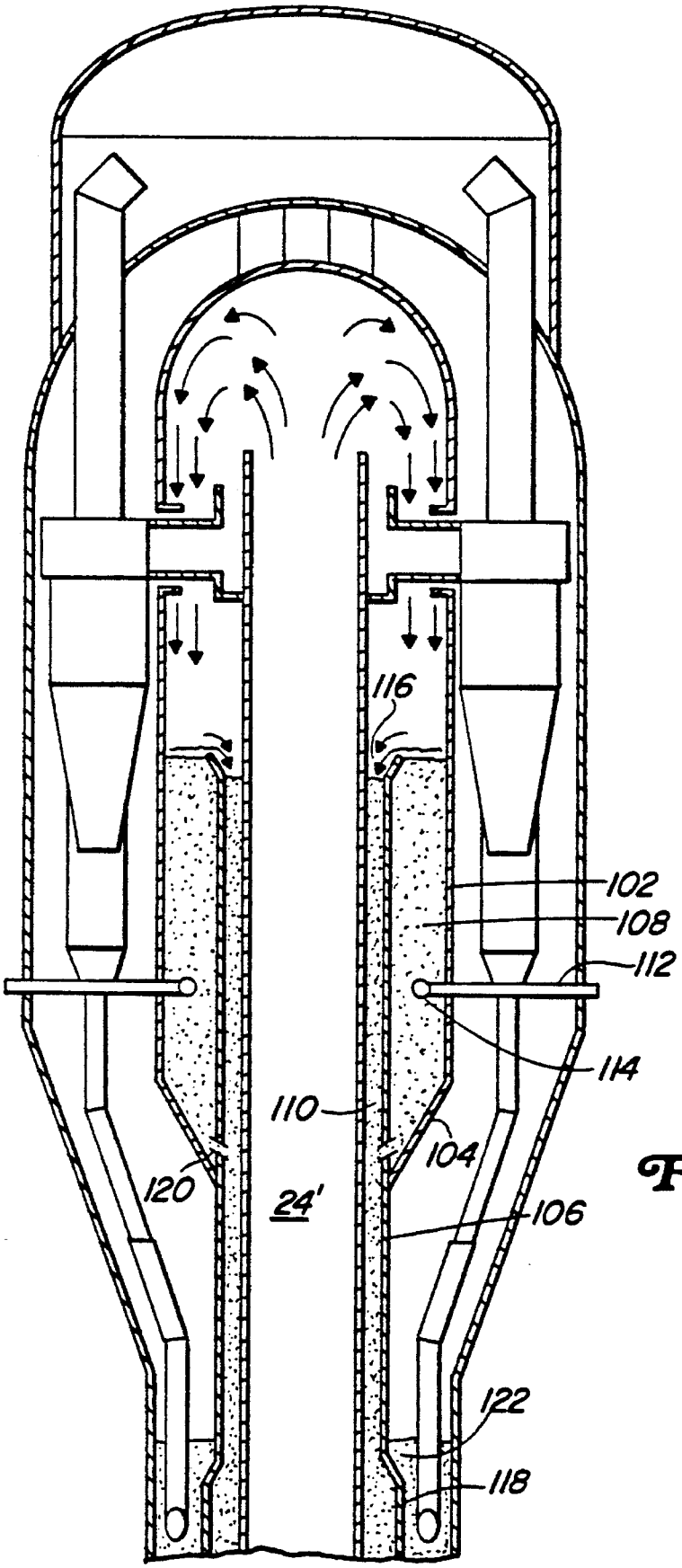
FIG. 4 is a sectional elevation of another disengaging vessel in which the invention of this application may be practiced.

It is possible to operate the method of this invention with a simplified apparatus arrangement in the lower portion of the disengaging zone. Such an apparatus is shown in FIG. 4 and unless otherwise stated, the apparatus of FIG. 4 operates in all respects in the same manner as that shown in FIGS. 1 and 2. The major difference in the apparatus of FIG. 4 is the arrangement of the lower section of the disengaging zone and the method for discharing catalyst out of that zone. In FIG. 4 a sidewall 102 and a bottom closure 104 enclose the lower portion of the disengaging zone. A conduit 106 concentrically surrounds riser 24' to contain a dense catalyst bed 108 between its outer wall and the interior of sidewall 102 and an annular catalyst flow passage 110 in the space between the inner wall of conduit 106 and the outer wall of riser 24'. Catalyst discharged from the top of riser 24' collects in catalyst bed 108. A supply pipe 112 delivers stripping fluid to a distributor 114 that distributes the stripping fluid upwardly into contact with the catalyst in bed 108. The upward velocity of the stripping gas through bed 108 and the downward velocity of the catalyst that enters the stripping bed mixes the catalyst within bed 108.

Overflow catalyst from bed 108 spills into inlet 116 and passes downwardly through annular passageway 110. Inlet opening 116 has an enlarged diameter with respect to the annular passage to promote gas disengagement from the catalyst before it flows downwardly through passageway 110. The bottom 118 of annular passage 110 has an enlarged opening to disengage gas from the catalyst and lower the interstitial void volume of the catalyst in this section. A small amount of additional catalyst enters the passage from drain ports 120 which are provided at the bottom of bed 108 to drain catalyst from bed 108 when the unit is shut down.

In the arrangement of FIG. 4, the height of the dense bed in the disengaging zone is determined by the location of inlet 116 relative to the location of the stripping fluid distributor 114. In order to maintain the gas seal, the bottom of annular passage 110 is immersed in a dense bed 122. An additional stripping operation takes place below dense bed 122. Thus, a stripping effluent stream flows upwardly out of dense bed 122 and can be removed from the reactor vessel by a separate vent or through the disengaging zone. The operation of the stripper in FIG. 4 is simpler than that disclosed in FIG. 2 since there is no upcomer or downcomer in which to maintain catalyst.

The arrangement of FIG. 4 may be modified to replace the annular passageway 110 with one or more circular conduits that pass through the bottom of the disengaging zone. Such an arrangement is shown in FIG. 5 which again shows an FCC arrangement that operates in the same manner as the apparatus shown in FIGS. 1, 2 and 4 unless otherwise noted. In a manner similar to that described in FIG. 4, catalyst collects at the bottom of the disengaging zone in a dense bed 124. An outer cylindrical sidewall 132 and an inner cylindrical sidewall 134 contain the sides of catalyst bed 124. The catalyst is contacted therein with a stripping fluid. Catalyst is carried out of the disengaging zone by a plurality of standpipes 126 that pass through a bottom plate 128 of the disengaging zone. The height of bed 124 is set by the position of pipe inlets 130. In order to maximize the horizontal width of bed 124 at its top, opening 130 is formed by cutting a semi-circular section out of the top of standpipes 126. This form of opening creates a flow path that moves the catalyst around the backside of the conduit before exiting the bed. Moreover, the additional open area provided by the semi-circular inlet 130 promotes gas disengaging from the catalyst as it enters the standpipes 136. At the bottom of the standpipes, where the catalyst exits, the standpipes are immersed into a lower particle bed 136 to maintain a gas seal between the dilute phase of the disengaging zone and the interior of the reactor vessel. Stripping effluent vapors rising from bed 136 are vented into the dilute phase of the disengaging vessel through an annular space 142 formed between inner sidewall 134 and riser section 24". Annular space 142 is in open communication with the dilute phase of the reactor above the stripper dense bed.

Intermixing of catalyst along the vertical length of bed 124 can be increased by providing openings 138 that communicate catalyst from a lower section of bed 124 directly into conduit 126. Addition of holes 138 promotes a plug type flow for a portion of the catalyst through bed 124. The plug type flow is in addition to the backmix type flow that occurs as catalyst spills over the top of conduit 126 through opening 130. In addition to openings 138, small drain holes 140 are also provided at the bottom of the disengaging zone to drain catalyst from bed 124 when the unit is shut down.

Figure 5:
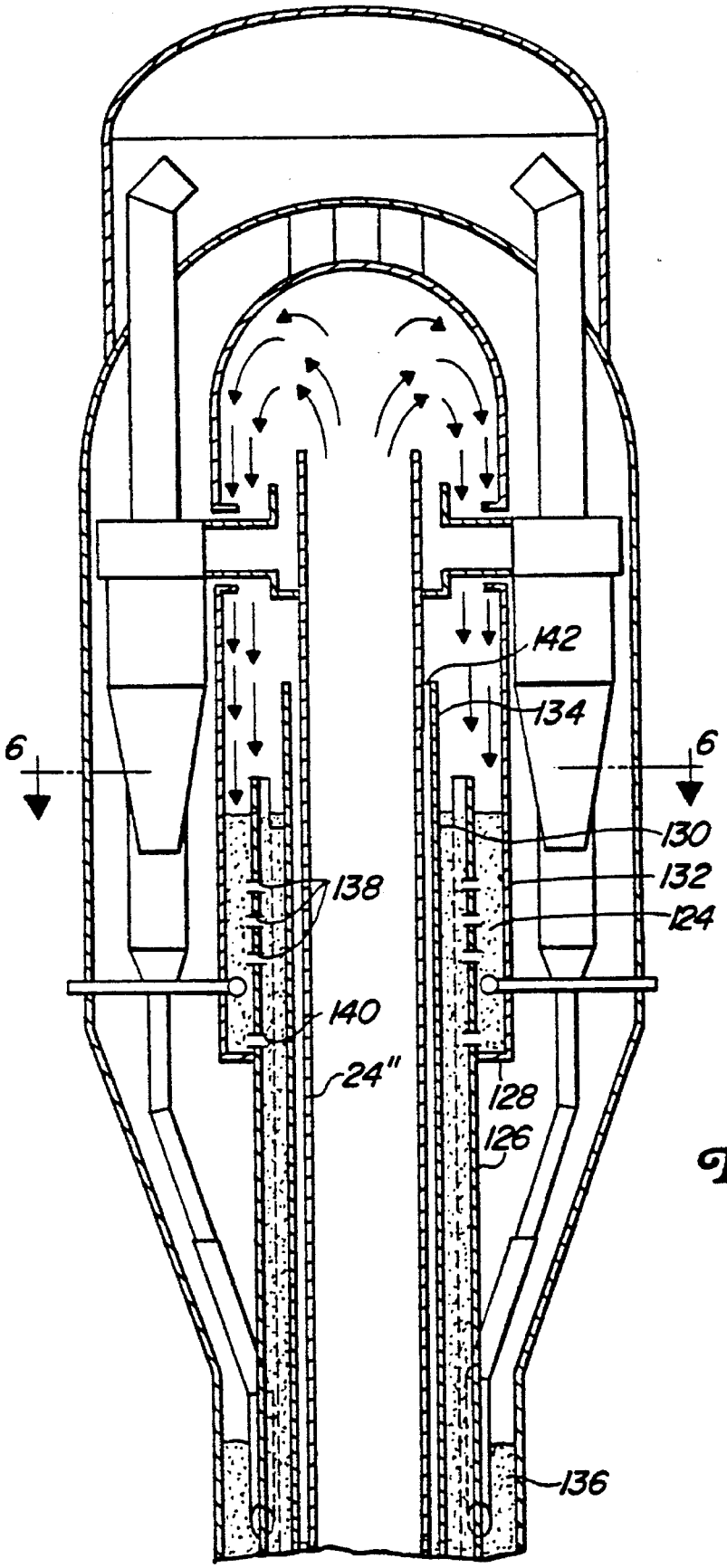
FIG. 5 is a modified sectional elevation of the disengaging vessel of FIG. 4.
Figure 6:
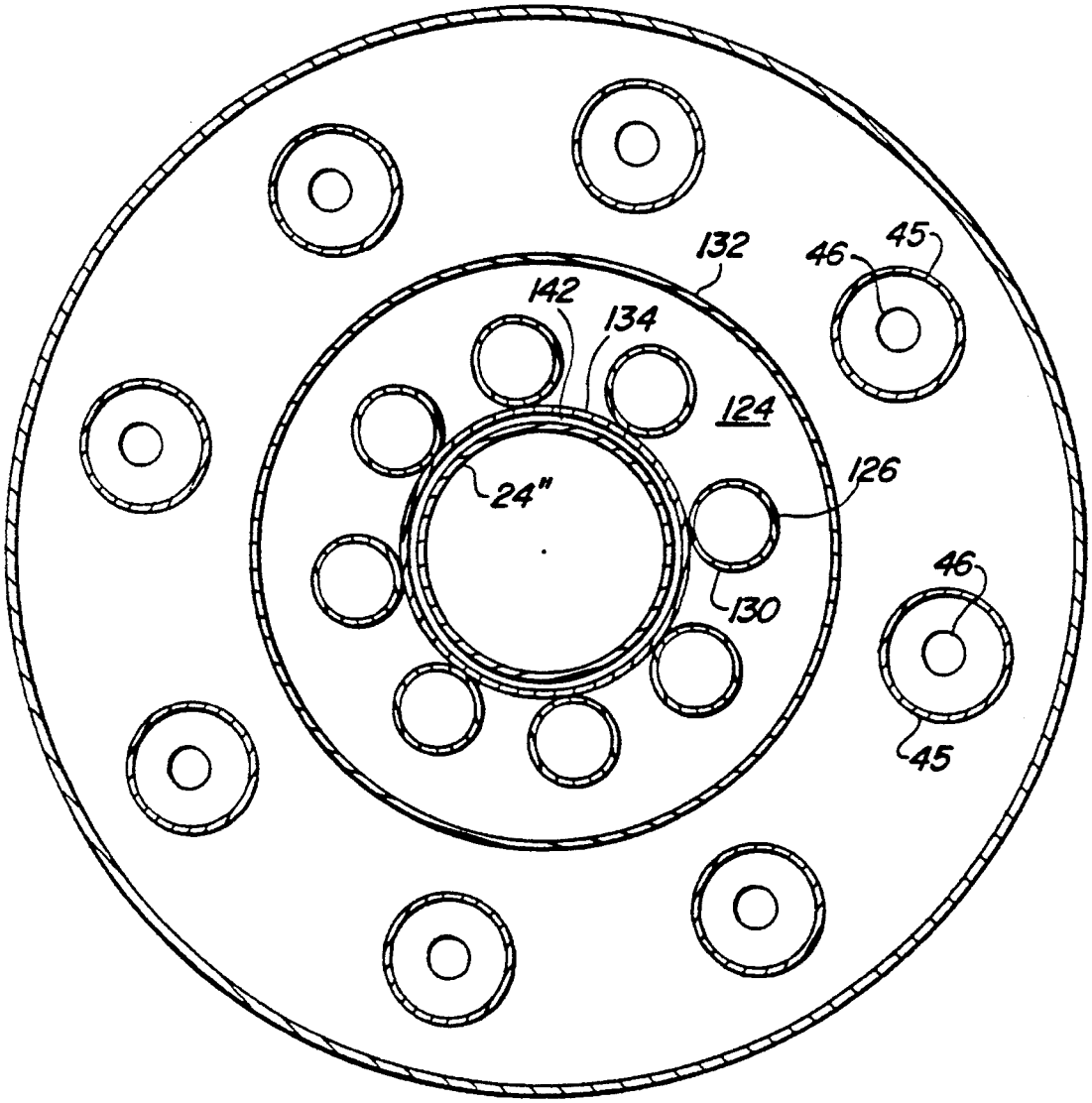
FIG. 6 is a cross-section of FIG. 5 taken across line 6—6 of FIG. 6.

The arrangement of the conduits and annular space in FIG. 5 is further illustrated in FIG. 6. Referring then to FIG. 6, catalyst in dilute phase flows upwardly through the interior of riser 24". After disengagement from the product vapors, catalyst accumulates in bed 124 until it flows over semi-circular opening 130 into conduit 126. Additional catalyst may be withdrawn through holes in conduit 126 that communicate with lower portions of the catalyst bed 124 (not shown). The stripping effluent from the subadjacent stripping zone that contacts the catalyst from standpipes 126 and from hoppers 45 of the cyclones reenters the disengaging zone through annular chamber 142.

Figure 7:
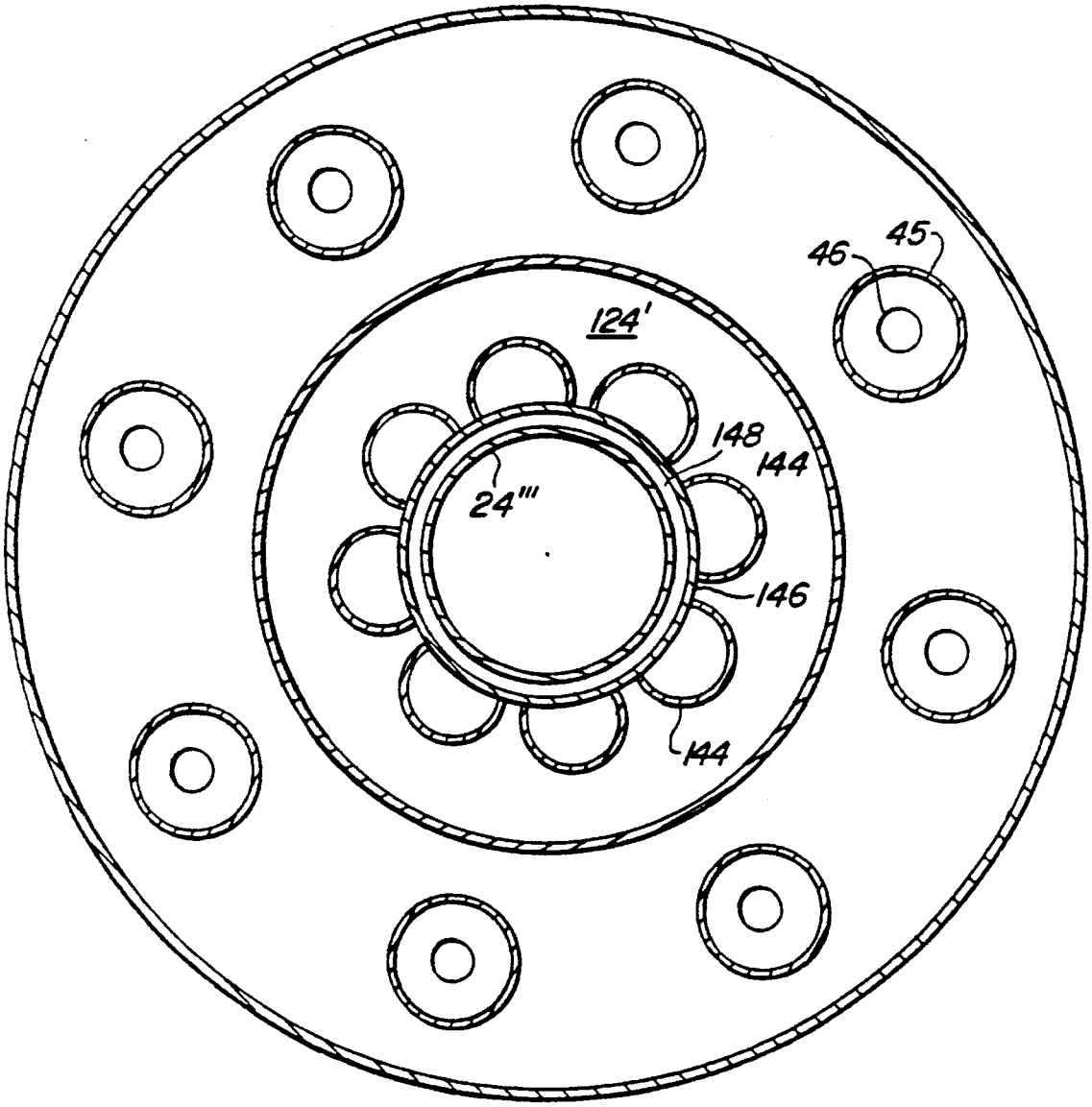
FIG. 7 is a cross-section of FIG. 6.

The arrangement of FIG. 5 is not limited to the use of circular conduits. A variety of conduit shapes can be used to transfer catalyst from an upper level of the dense bed disengaging zone and through the bottom of the disengaging zone. As previously mentioned, the conduits will preferably have inlets that maximize the horizontal width at the top of the catalyst bed. One such alternate arrangement for conduits is shown in FIG. 7. FIG. 7 shows a plan view of modified conduits in a disengaging zone and reactor vessel arrangement that, except for the configuration of the conduits and the inner wall, is essentially the same as that shown in FIGS. 5 and 6. The arrangement of FIG. 7 uses conduits 144 having a scalloped shape. The scalloped shape permits the conduits to be placed closer to the center of the disengaging zone. The more centralized location of the conduits maximizes the horizontal open space in bed 124'. An inner sidewall 146 in a lower portion of the disengaging zone provides a back closure to which the walls of all conduits 144 are attached. An annular space 148 between sidewall 148 and a central riser conduit 24" communicates the stripping effluent from the reactor vessel into the disengaging zone and is again in open communication with the dilute phase of the reactor above the stripper dense bed.

The foregoing description sets forth the essential features of this invention which can be adapted to a variety of applications and arrangements without departing from the scope and spirit of the claims hereafter presented.

We claim:

1. An apparatus for the fluidized catalytic cracking (FCC) of an FCC feedstock by contact with an FCC catalyst, said apparatus comprising:

a) an upwardly directed riser conduit having an upwardly directed outlet end adapted to upwardly discharge FCC catalyst particles;

b) a reactor vessel surrounding said outlet end;

c) a disengaging vessel at least partially contained within said reactor vessel and surrounding said outlet end, said disengaging vessel having a bottom substantially closed to direct catalyst flow, a downwardly extending sidewall and an overlapping, upwardly extending sidewall, said riser and said downwardly extending sidewall define an inner annular passageway, said upwardly extended sidewall and said downwardly extended sidewall define an outer annular passageway that communicates with said inner annular passageway and the upper end of said outer passageway providing a catalyst outlet, and an open volume above said riser to receive said upwardly discharged catalyst particles;

d) a distributor in said disengaging vessel located below said catalyst outlet for introducing a gaseous medium into said disengaging vessel;

e) a stripping vessel subadjacent to and in communication with said reactor vessel; and, f) a product outlet in said disengaging vessel for withdrawing a product stream from an upper portion of said disengaging vessel.

2. The apparatus of claim 1 wherein said product outlet includes an annular collector that surrounds said outlet end.

3. The apparatus of claim 1 wherein the upper end of said disengaging vessel is located between 1 to 8 riser diameters above said outlet end.

* * * * *